US011453572B2

(12) United States Patent
Shimabayashi et al.

(10) Patent No.: US 11,453,572 B2
(45) Date of Patent: Sep. 27, 2022

(54) SPACE SAVING ARRANGEMENT OF A MACHINE-ROOM-LESS ELEVATOR DEVICE

(71) Applicant: Mitsubishi Electric Corporation, Tokyo (JP)

(72) Inventors: Keita Shimabayashi, Tokyo (JP); Yoshinori Tani, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 99 days.

(21) Appl. No.: 16/489,699

(22) PCT Filed: Apr. 26, 2017

(86) PCT No.: PCT/JP2017/016553
§ 371 (c)(1),
(2) Date: Aug. 29, 2019

(87) PCT Pub. No.: WO2018/198230
PCT Pub. Date: Nov. 1, 2018

(65) Prior Publication Data
US 2020/0039790 A1 Feb. 6, 2020

(51) Int. Cl.
*B66B 7/02* (2006.01)
*B66B 5/00* (2006.01)
(Continued)

(52) U.S. Cl.
CPC ..... *B66B 7/02* (2013.01); *B66B 5/0075* (2013.01); *B66B 11/08* (2013.01); *B66B 17/12* (2013.01)

(58) Field of Classification Search
CPC ..... B66B 7/02; B66B 5/0075; B66B 11/08; B66B 17/12
See application file for complete search history.

(56) References Cited

U.S. PATENT DOCUMENTS 5,899,300 A * 5/1999 Miller ..... B66B 7/02 187/256
6,446,762 B1 * 9/2002 St. Pierre ..... B66B 7/024 187/406
(Continued)

FOREIGN PATENT DOCUMENTS

CN 1226178 C * 11/2005 ..... B66B 11/0438
CN 102421693 A 4/2012
(Continued)

OTHER PUBLICATIONS

Nagata, Koji and Hisamitsu, Yukimasa, Lifter and the Lifter of Elevator System, Nov. 9, 2005, English translation of the description of CN 1226178 C (Year: 2005).*
(Continued)

*Primary Examiner* — Michael R Mansen
*Assistant Examiner* — Michelle M Lantrip
(74) *Attorney, Agent, or Firm* — Xsensus LLP

(57) ABSTRACT

Provided is an elevator device, in which a hoisting machine includes a main shaft, a brake drum rotatable about an axis of the main shaft, and a brake unit arranged at a position on a radially outer side of the brake drum. The brake unit includes a movable member and presses the movable member in an obliquely upward direction against an outer peripheral surface of the brake drum to apply a braking force to the brake drum. The car guide rail is retained by an upper rail bracket at a position higher than a position of the machine base. The brake unit is arranged at a position higher than the machine base and lower than the upper rail bracket.

6 Claims, 6 Drawing Sheets

(51) Int. Cl.
*B66B 11/08* (2006.01)
*B66B 17/12* (2006.01)

(56) References Cited

U.S. PATENT DOCUMENTS

| | | | | |
|---|---|---|---|---|
| 6,991,069 | B1 * | 1/2006 | Ach | B66B 7/027 187/406 |
| 9,434,578 | B2 * | 9/2016 | Det | B66B 11/0045 |
| 2003/0070881 | A1 | 4/2003 | Nagata et al. | |
| 2015/0021122 | A1 | 1/2015 | Maruyama | |

FOREIGN PATENT DOCUMENTS

| | | | | |
|---|---|---|---|---|
| CN | 106144844 | A * | 11/2016 | |
| EP | 1422183 | A1 * | 5/2004 | B66B 11/008 |
| JP | 2001-187678 | A | 7/2001 | |
| JP | 2001187678 | A | 7/2001 | |
| JP | 2003-104666 | A | 4/2003 | |
| JP | 3726605 | B2 | 12/2005 | |
| JP | 2007277015 | A | 10/2007 | |
| JP | 5805212 | B2 | 11/2015 | |
| JP | 2016-204087 | A | 12/2016 | |
| KR | 200332820 | Y1 * | 11/2003 | |
| KR | 200424453 | Y1 * | 8/2006 | B66D 5/08 |
| KR | 20060124845 | A * | 12/2006 | |
| KR | 20150022917 | A * | 3/2015 | B66B 11/008 |
| WO | 01/89975 | A1 | 11/2001 | |

OTHER PUBLICATIONS

Elevator Winch Having Direct Electron Brake of Drum Type, Aug. 22, 2006, Machine Translation of KR 200424453 Y1 (Year: 2006).*
Set Up Structure of a Winch for an Elevator, Nov. 10, 2003, Machine translation of KR200332820Y1 (Year: 2003).*
International Search Report and Written Opinion dated Jul. 25, 2017 for PCT/JP2017/016553 filed on Apr. 26, 2017, 9 pages including English Translation of the International Search Report.
Office Action dated Jun. 28, 2020, issued in corresponding Chinese Patent Application No. 201780089733.9, 16 pages.
Chinese Office Action dated Mar. 8, 2021, in corresponding Chinese Patent Application No. 201780089733.9.

* cited by examiner

SPACE SAVING ARRANGEMENT OF A MACHINE-ROOM-LESS ELEVATOR DEVICE

CROSS-REFERENCE TO RELATED APPLICATION

The present application is based on PCT filing PCT/JP2017/016553, filed Apr. 26, 2017, the entire contents of which are incorporated herein by reference.

TECHNICAL FIELD

The present invention relates to an elevator device in which a hoisting machine is provided in an upper part of a hoistway.

BACKGROUND ART

In order to achieve space saving in a hoistway, there has hitherto been proposed a machine-room-less type elevator device in which a hoisting machine is arranged in an upper part of the hoistway and car guide rails configured to guide a car are arranged at positions closer to a driving sheave for the hoisting machine than to brakes for the hoisting machine. The brakes for the hoisting machine are arranged on both sides of the hoisting machine in a horizontal direction of the hoistway (see, for example, Patent Literature 1).

Further, there has also hitherto been proposed a machine-room-less type elevator device in which a hoisting machine is arranged in an upper part of a hoistway and brakes for the hoisting machine are arranged on a top of the hoisting machine (see, for example, Patent Literature 2).

CITATION LIST

Patent Literature

[PTL 1] JP 5805212 B2
[PTL 2] JP 2016-204087 A.

SUMMARY OF INVENTION

Technical Problem

In the machine-room-less type elevator, when the hoisting machine is arranged above a counterweight, a range of vertical movement of the counterweight can be increased with reduction of a dimension from a machine base configured to support the hoisting machine to a ceiling of the hoistway. Meanwhile, in the machine-room-less type elevator, in terms of safety, a dimension from an upper surface of a car to the ceiling of the hoistway at the time of maintenance work for the hoisting machine is required to be set equal to or larger than a reference value determined by regulations.

In the related-art elevator device described in Patent Literature 1, a rail bracket located at an uppermost position, which supports each of the car guide rails, is arranged above an upper surface of the hoisting machine. Thus, the rail bracket located at the uppermost position is required to be arranged in a space above the hoisting machine, which results in increase in dimension from the machine base to the ceiling of the hoistway. Thus, in the related-art elevator device described in Patent Literature 1, the range of vertical movement of the counterweight is reduced. Hence, the space saving in the hoistway cannot be achieved.

Further, in the related-art elevator device described in Patent Literature 2, a vertical dimension of the entire hoisting machine including the brakes is increased. Thus, the dimension from the machine base to the ceiling of the hoistway is increased. Further, in the related-art elevator device described in Patent Literature 2, the brakes are arranged on the top of the hoisting machine. Thus, a position of the hoisting machine is required to be set low so as to be separated from the ceiling of the hoistway in order to enable a maintenance personnel on the upper surface of the car to access the brakes while ensuring the dimension from the upper surface of the car to the ceiling of the hoisting machine during the maintenance work. As a result, the dimension from the machine base to the ceiling of the hoistway is further increased. Thus, even in the related-art elevator device described in Patent Literature 2, the range of vertical movement of the counterweight is reduced. Hence, the space saving in the hoistway cannot be achieved The present invention has been made to solve the problems described above, and has an object to provide an elevator device capable of achieving space saving in a hoistway.

Solution to Problem

According to one embodiment of the present invention, there is provided an elevator device, including: a car vertically movable in a hoistway; a car guide rail, which is provided in the hoistway, and is configured to guide the car; a counterweight vertically movable in the hoistway; a counterweight guide rail, which is provided in the hoistway, and is configured to guide the counterweight; a hoisting machine, which is provided is as upper part of the hoistway, and is configured to generate a driving force for moving the car and the counterweight; and a machine base configured to support the hoisting machine, wherein the hoisting machine includes a main shaft, a brake drum rotatable about an axis of the main shaft, and a brake unit arranged at a position on a radially outer side of the brake drum, wherein the brake unit includes a movable member and presses the movable member in an obliquely upward direction against an outer peripheral surface of the brake dram to apply a braking force to the brake drum, and wherein the car guide rail is retained by an upper rail bracket at a position higher than a position of the machine base, and wherein the brake unit is arranged at a position higher than the machine base and lower than the upper rail bracket.

Advantageous Effects of Invention

In the elevator device according to one embodiment of the present invention, the position of the machine base can be set closer to a ceiling of the hoistway, and hence a range of movement of the counterweight can be increased. As a result, the space saving in the hoistway can be achieved.

DESCRIPTION OF EMBODIMENTS

Now, an embodiment of the present invention is described with reference to the drawings.

First Embodiment

Figure 1:
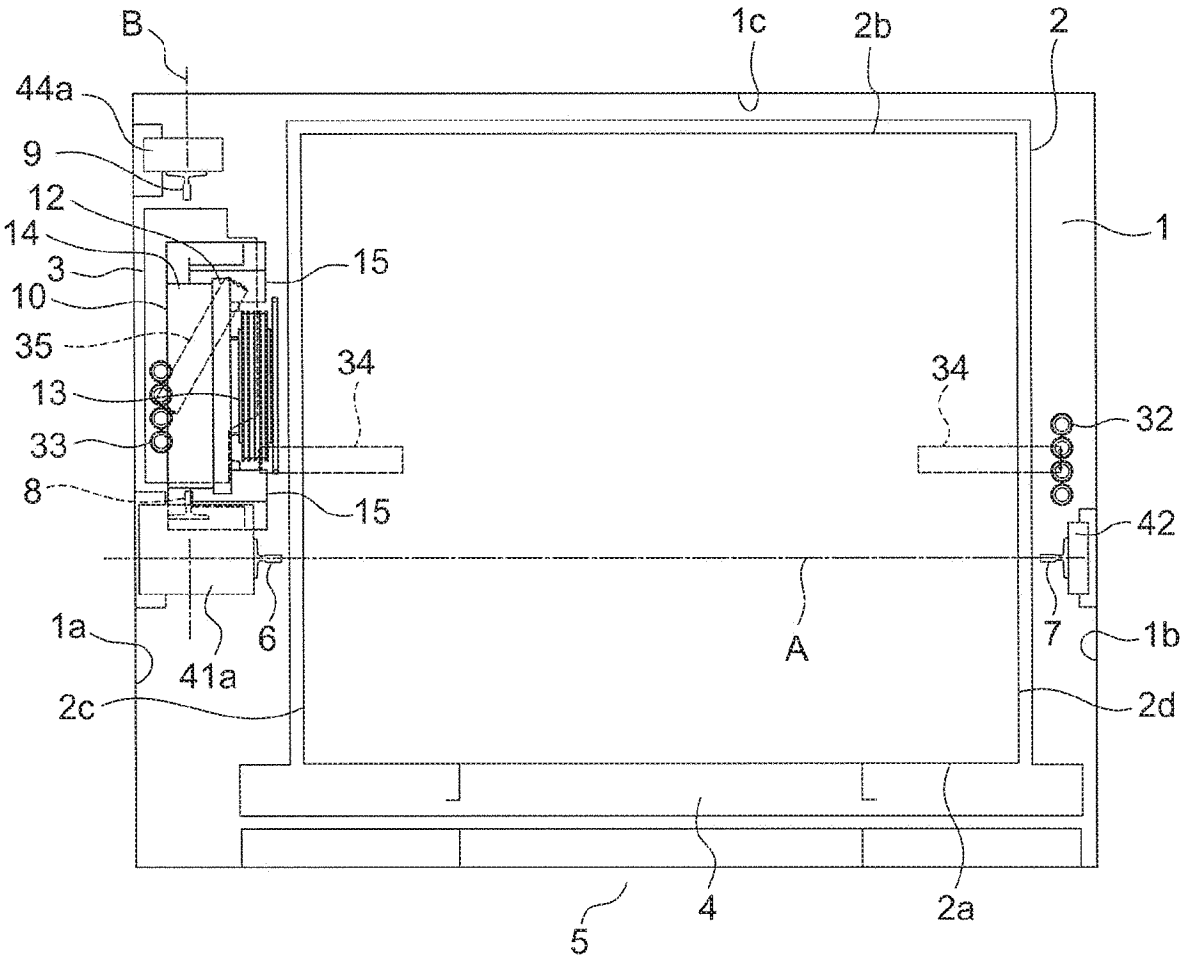
FIG. 1 is a top view for illustrating an elevator device according to a first embodiment of the present invention.
Figure 2:
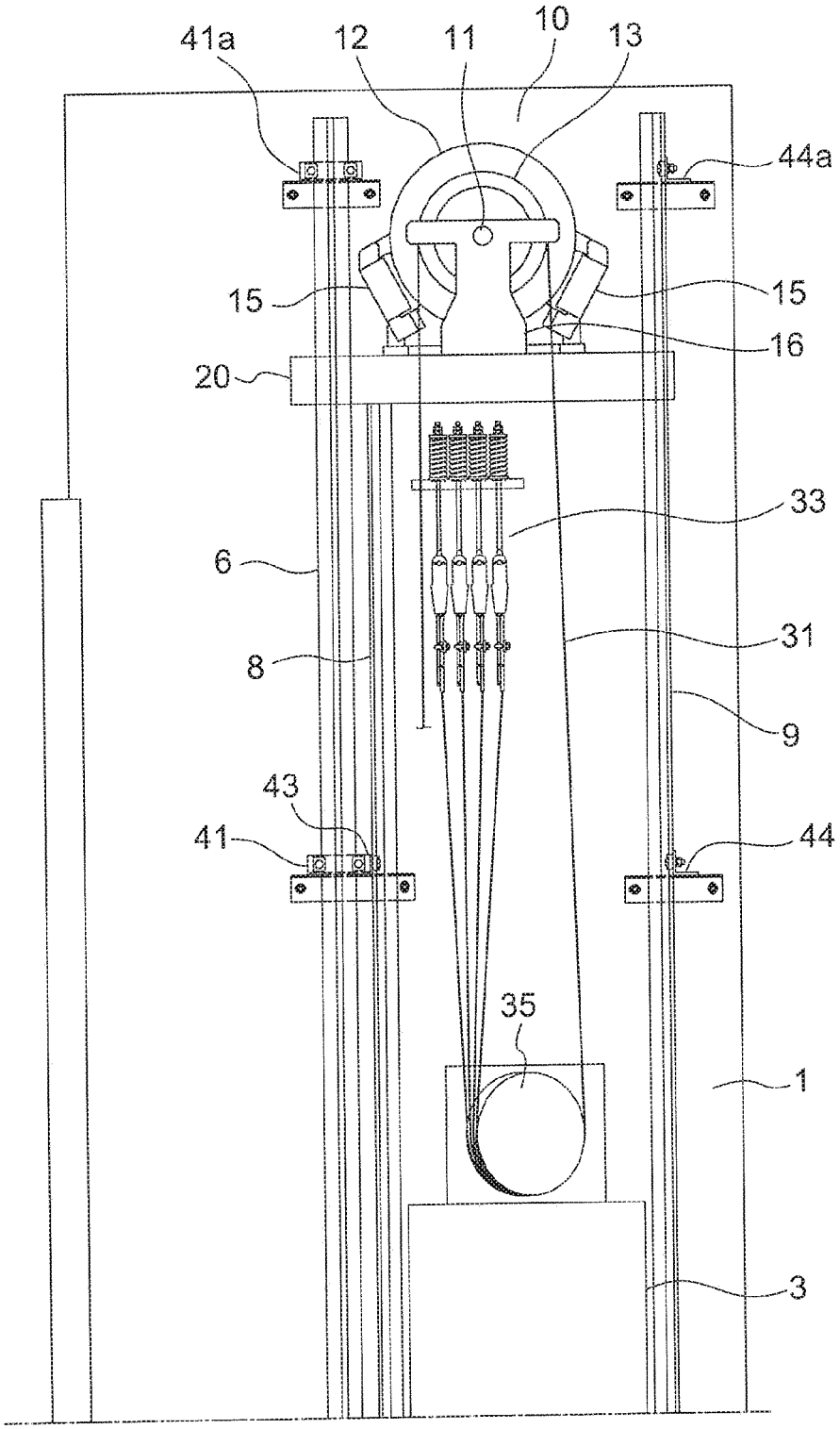
FIG. 2 is a front view for illustrating a hoisting machine as viewed from a car side of FIG. 1.

FIG. 1 is a top view for illustrating an elevator device according to a first embodiment of the present invention. FIG. 2 is a front view for illustrating a hoisting machine as viewed from a car side of FIG. 1. In FIG. 1 and FIG. 2, a car 2 and a counterweight 3 are provided in a hoistway 1 so that the car 2 and the counterweight 3 can be raised and lowered. The car 2 has a bottom surface, an upper surface 2*e*, a front surface 2*a*, a back surface 2*b*, and a pair of side surfaces 2*c* and 2*d*. The front surface 2*a* and the back surface 2*b* of the car 2 are opposed to each other in a depth direction of the hoistway 1, and the pair of the side surfaces 2*c* and 2*d* of the car 2 are opposed to each other in a width direction of the hoistway 1. On the front surface 2*a* of the car 2, a car doorway 4 is formed. The car 2 is arranged with the car doorway 4 oriented toward a landing 5 of each floor as viewed from above.

The hoistway 1 has a hoistway wall surface 1*a*, a hoistway wall surface 1*b*, and a hoistway wall surface 1*c*. The hoistway wall surface 1*a* is opposed to one side surface 2*c* of the car 2. The hoistway wall surface 1*b* is opposed to another side surface 2*d* of the car 2. The hoistway wall surface 1*c* is opposed to the back surface 2*b* of the car 2.

Further, the counterweight 3 is arranged in the space between the one hoistway wall surface 1*a* and the one side surface 2*c* of the car 2 as viewed from above with this arrangement, the elevator device in the first embodiment is configured as a counterweight side drop type elevator device.

Inside the hoistway 1, a first car guide rail 6, a second car guide rail 7, a first counterweight guide rail 8, and a second counterweight guide rail 9 are installed.

The first car guide rail 6 and the second car guide rail 7 are opposed to each other in the width direction of the hoistway 1. The car 2 is arranged between the first car guide rail 6 and the second car guide rail 7. The first car guide rail 6 is arranged in the space between the one hoistway wall surface 1*a* and the one side surface 2*c* of the car 2. The second car guide rail 7 is arranged in the space between the another hoistway wall surface 1*b* and the another side surface 2*d* of the car. Further, the car 2 is vertically moved in the hoistway 1 while being guided by the first car guide rail 6 and the second car guide rail 7.

The first counterweight guide rail 8 and the second counterweight guide rail 9 are opposed to each other in a depth direction of the hoistway 1. With this arrangement, when the hoistway 1 is viewed from above, as illustrated in FIG. 1, a straight line B that connects the first counterweight guide rail 8 and the second counterweight guide rail 9 is orthogonal to a straight line A that connects the first car guide rail 6 and the second car guide rail 7.

The counterweight 3 is arranged between the first counterweight guide rail A and the second counterweight guide rail 9. The counterweight 3, the first counterweight guide rail 8, and the second counterweight guide rail 9 are arranged in the space between the one hoistway wall surface 1*a* and the one side surface 2*c* of the car 2 as viewed from above. Further, the counterweight 3, the first counterweight guide rail 8, and the second counterweight guide rail 9 are arranged on a far side as viewed from the landing 5 with respect to the straight line A that connects the first car guide rail 6 and the second car guide rail 7 as viewed from above. The first counterweight guide rail 8 is arranged at a position closer to the first car guide rail than to the second counterweight guide rail 9. The counterweight 3 is vertically moved in the hoistway 1 while being guided by the first counterweight guide rail 8 and the second counterweight guide rail 9.

In an upper part of the hoistway 1, as illustrated in FIG. 2, a hoisting machine 10 and a machine base 20 are provided. The hoisting machine 10 is a driving device configured to generate a driving force for moving the car 2 and the counterweight 3. The machine base 20 is configured to support the hoisting machine 10. The hoisting machine 10 and the machine base 20 are arranged above a range of vertical movement of the counterweight 3.

As illustrated in FIG. 2, a height of the first counterweight guide rail 8 is lower than each of a height of the first car guide rail 6 and a height of the second counterweight guide rail 9. The machine base 20 is placed on an upper end surface of the first counterweight guide rail 8. Further, the machine base 20 is fixed to the first car guide rail 6, the first counterweight guide rail 8, and the second counterweight guide rail 9.

The hoisting machine 10 is a thin type hoisting machine having a radial dimension larger than an axial dimension. The hoisting machine 10 is, as illustrated in FIG. 2, placed on an upper surface of the machine base 20. When the hoisting machine 10 is viewed from the car 2 side, the hoisting machine 10 is arranged between the first car guide rail 6 and the second counterweight guide rail 9. Further, as illustrated in FIG. 1, the hoisting machine 10 is arranged in a space between one hoistway wall surface 1*a* and the one side surface 2*c* of the car 2 as viewed from above.

The hoisting machine 10 includes a main shaft 11, a brake drum 12, a driving sheave 13, a motor 14, a plurality of brake units 15, and a housing 16. The main shaft 11 is horizontally arranged. The brake drum 12 is rotatable about, an axis of the main shaft 11. The driving sheave 13 is rotated integrally with the brake drum 12. The motor 14 is configured to rotate the brake drum 12 and the driving sheave 13. The plurality of brake units 15 are configured to apply a braking force to the brake drum 12 and the driving sheave 13. The housing 16 is configured to support the main shaft 11, the brake drum 12, the driving sheave 13, the motor 14, and the plurality of brake units 15. In this example, the hoisting machine 13 is arranged under a state in which the driving sheave 13 is oriented toward the car 2 and the motor 14 is oriented toward the hoistway wall surface 1*a*.

The car 2 and the counterweight 3 are suspended by a plurality of cord-like members 31 inside the hoistway 1. As the cord-like members 31, for example, ropes or belts are used. In the upper part of the hoistway 1, a first rope stopper device 32 and a second rope stopper device 33 are provided. A pair of car suspension sheaves 34 is provided to a lower part of the car 2. A counterweight suspension sheave 35 is provided to a top of the counterweight 3.

One end of each of the cord-like members 31 is connected to the first rope stopper device 32, and another end of each of the cord-like members 31 is connected to the second rope stopper device 33. Each of the cord-like members 31 extends from the first rope stopper device 32 to be sequentially wound around the pair of car suspension sheaves 34, the driving sheave 13, and the counterweight suspension sheave 35 to reach the second rope stopper device 32. Specifically, the car 2 and the counterweight 3 are suspended with a 2:1 roping method.

Figure 3:
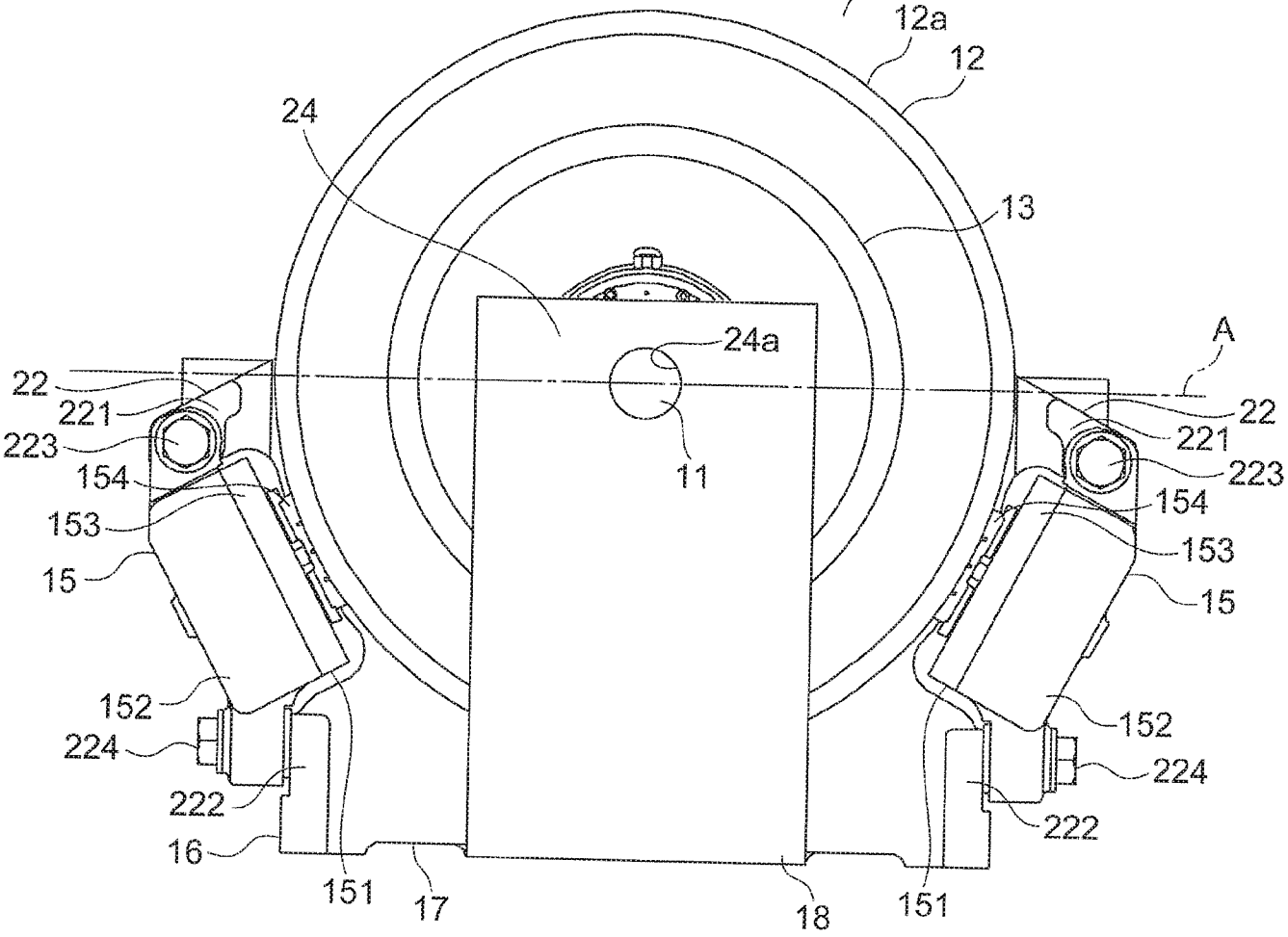
FIG. 3 is a front view for illustrating the hoisting machine of FIG. 2.
Figure 4:
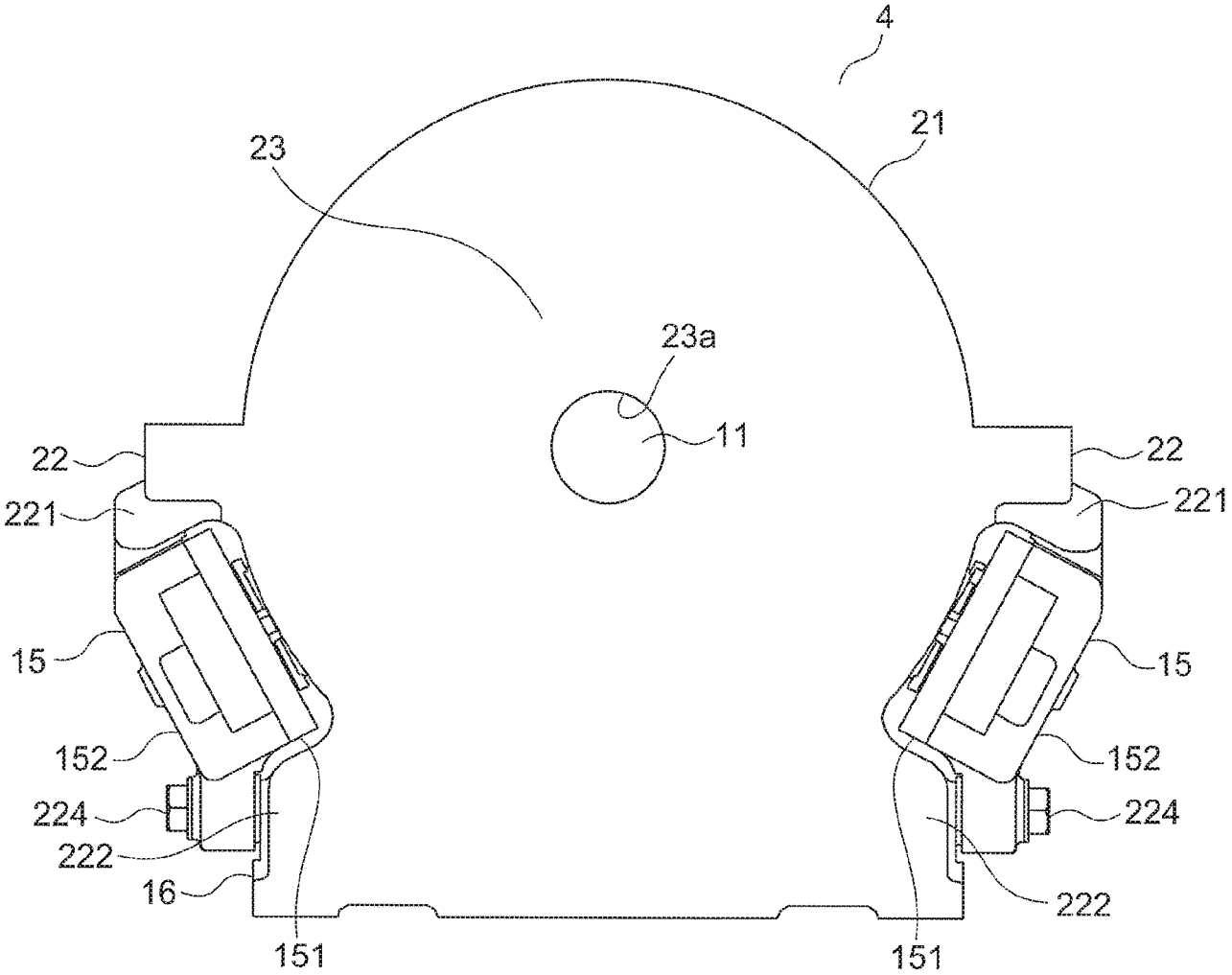
FIG. 4 is a back view for illustrating the hoisting machine of FIG. 2.
Figure 5:
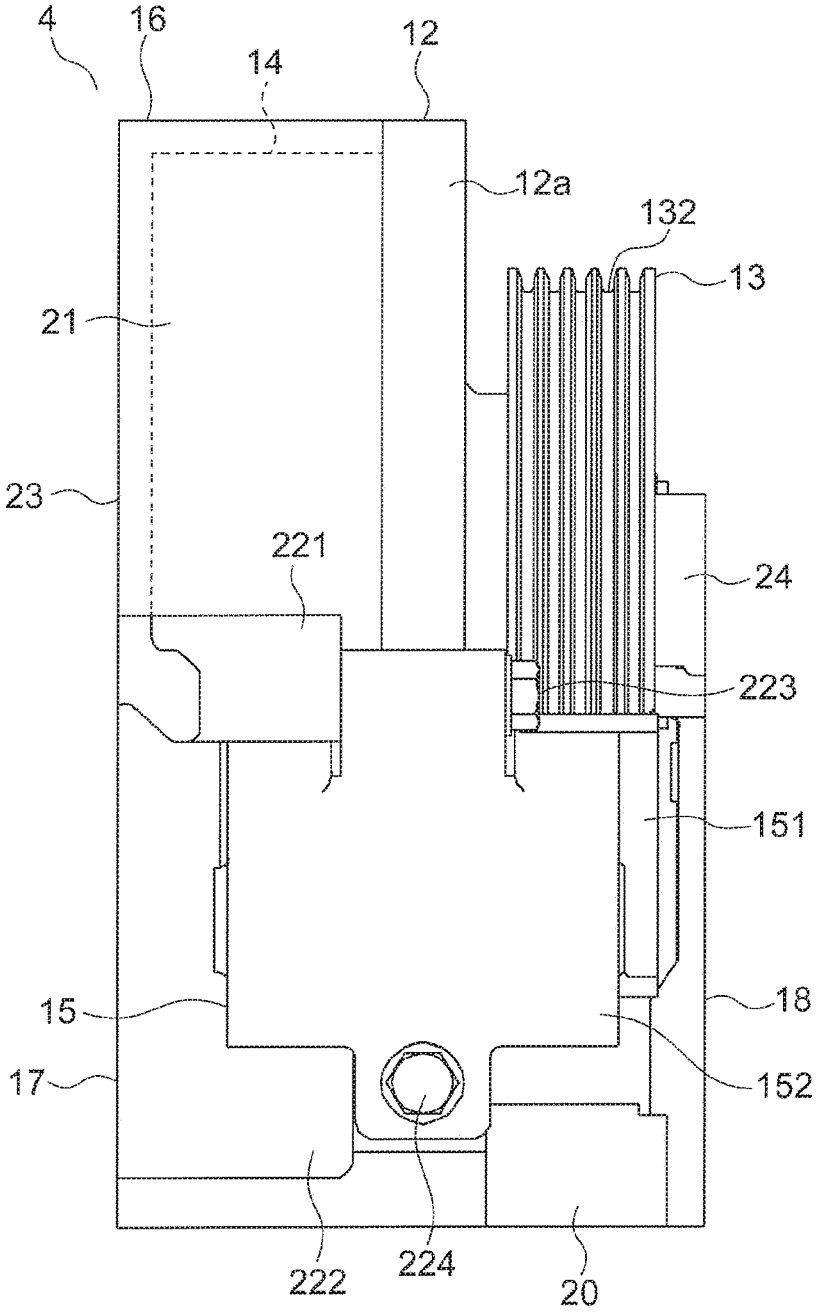
FIG. 5 is a side view for illustrating the hoisting machine 10 of FIG. 2.

Now, the hoisting machine 10 is described in detail. FIG. 3 is a front view for illustrating the hoisting machine 10 of FIG. 2. FIG. 4 is a back view for illustrating the hoisting machine 10 of FIG. 2. FIG. 5 is a side view for illustrating the hoisting machine 10 of FIG. 2. The main shaft 11 is fixed horizontally to the housing 16. The brake drum 12 is rotatably mounted to the main shaft 11 through intermediation of a bearing (not shown). An outer peripheral surface 12*a* of the brake drum 12 is formed as a cylindrical surface having the axis of the main shaft 11 as a center.

The driving sheave 13 is fixed to the brake drum 12. As a result, the driving sheave 13 is rotated integrally with the brake drum 12. In this example, an outer diameter of the driving sheave 13 is smaller than an outer diameter of the brake drum 12.

Grooves 132, into which the cord-like members 31 are to be fitted, are formed on an outer peripheral portion of the driving sheave 13 along a circumferential direction of the driving sheave 13. The cord-like members 31 are wound around the outer peripheral portion of the driving sheave 13 along the grooves 132. As illustrated in FIG. 2, the cord-like members 31 wound around the outer peripheral portion of the driving sheave extend downward from the driving sheave 13. With the arrangement described above, a direction of a load received by the main shaft 11 from the cord-like members 31 is oriented downward. The car 2 and the counterweight 3 are vertically moved in the hoistway through the rotation of the driving sheave 13.

The motor 14 includes a cylindrical stator and a cylindrical rotor, which rotates relative to the stator. The rotor is arranged on a radially inner side of the stator. The stator and the rotor are arranged coaxially with the axis of the main shaft 11. The rotor rotates about the axis of the main shaft 11 relative to the stator. In this example, an outer diameter of the motor 14 is larger than the outer diameter of the driving sheave 13.

The rotor includes a plurality of magnets. The rotor is fixed to the brake drum 12. With the configuration described above, the rotor is rotated integrally with the brake drum 12.

The stator includes a stator core and a stator coil. When the stator coil is energized, the stator generates a rotating magnetic field. The rotor is rotated relative to the stator by the rotating magnetic field generated by the stator.

As illustrated in FIG. 3, the plurality of brake units 15 are arranged at positions on a radially outer side of the brake drum 12. In this example, the number of brake units 15 is two. As illustrated in FIG. 1, the brake units 15 are arranged so as to be located not only at the positions on the radially outer side of the brake drum 12 but also at positions on a radially outer side of the driving sheave 13 and the motor 14.

Each of the brake units 15 includes, as illustrated in FIG. 3, a movable member 151 and a brake driving device 152 configured to displace the movable member 151. Each of the brake units 15 presses the movable member 151 against the outer peripheral surface 12*a* of the brake drum 12 to apply the braking force to the brake drum 12 and the driving sheave 13 and separates the movable member 151 from the brake drum 12 to cancel the braking force to the brake drum 12 and the driving sheave 13.

The movable member 151 includes an armature 153 and a lining 154 provided to the armature 153. The armature 153 is arranged between the brake drum 12 and the brake driving device 152 in the radial direction of the brake drum 12. The lining 154 is a friction member to be brought into contact with or separated from the outer peripheral surface 12*a* of the brake drum 12 by the displacement of the movable member 151. The armature 153, the lining 154, and the brake driving device 152 are arranged at the same position in a circumferential direction of the brake drum 12.

The brake driving device 152 includes a brake spring and an electromagnet. The brake spring is an elastic member configured to bias the movable member 151 in a direction in which the lining 154 is brought into contact with the outer peripheral surface 12*a* of the brake drum 12. The electromagnet is configured to displace the movable member 151 in a direction in which the lining 154 is separated away from the outer peripheral surface 12*a* of the brake drum 12 against a biasing force of the brake spring. When the energization of the electromagnet is stopped, the movable member 151 is pressed against the outer peripheral surface 12*a* of the brake drum 12 with the biasing force of the brake spring. When the electromagnet is energized, the electromagnet generates an electromagnetic attraction force for attracting the armature 153 to separate the movable member 151 from the brake drum 12. With the configuration described above, each of the brake units 15 is configured as a linear brake unit configured to displace the lining 154 without intermediation of an arm.

When the hoisting machine 10 is viewed along the axis of the main shaft 11, the two brake units 15 are arranged on an obliquely lower right side and an obliquely lower left side with respect to the main shaft 11 and the brake drum 12. Each of the brake units 15 presses the movable member 151 obliquely upward toward the axis of the main shaft 11 against the outer peripheral surface 12*a* of the brake drum 12 to apply the braking force to the brake drum 12 and the driving sheave 13. The arrangement of the brake unit 15 for pressing the movable member 151 in any one of a horizontal direction, an obliquely downward direction, and a vertically downward direction against the outer peripheral surface 12*a* of the brake drum 12 is prohibited. In this example, when the hoisting machine 10 is viewed along the axis of the main shaft 11, the plurality of brake units 15 are arranged in a region below a horizontal line A passing through the axis of the main shaft 11, and thus the brake units 15 are not arranged in a region above the horizontal line A passing through the axis of the main shaft 11. As a result, in a space above the horizontal line A passing through the axis of the main shaft 11, the outer peripheral surface 12*a* of the brake drum 12 is open to an outside.

When the hoisting machine 10 is viewed along the axis of the main shaft 11, as illustrated in FIG. 3, the brake units 15 are arranged at symmetrical positions with respect to a vertical line passing through the axis of the main shaft 11. Further, when the hoisting machine 10 is viewed along the axis of the main shaft 11, an upper end portion of each of the brake units 15 is arranged below the horizontal line A passing through the axis of the main shaft 11. Further, when the hoisting machine 10 is viewed along the axis of the main shaft 11, a distance from the vertical line passing through the axis of the main shaft 11 to a lower end portion of each of the brake units 15 is smaller than a distance from the vertical line passing through the axis of the main shaft 11 to the upper end portion of each of the brake units 15.

The housing 16 includes, as illustrated in FIG. 5, a first support member 17 and a second support member 18.

The first support member 17 includes a base portion 30, a stator fixing portion 21 having a cylindrical shape, a plurality of brake mounting portions 22, and a first main-shaft mounting portion 23. The stator fixing portion 21 is formed on the base portion 30. The plurality of brake mounting portions are formed on the base portion 30 and the stator fixing portion 21. The first main-shaft mounting portion 23 is formed on the stator fixing portion 21. The first support member 17 is formed of an integrally formed single member.

The base portion 30 is horizontally arranged along the axis of the main shaft 11 below the main shaft 11, the brake drum 12, the driving sheave 13, and the motor 14. A lower end portion of the second support member 18 is fixed to one axial end of the base portion 30, and a lower end portion of the stator fixing portion 21 is fixed to another axial end of the base portion 30. The brake drum 12, the driving sheave 13, and the motor 14 are arranged between the first main-shaft mounting portion 23 and the second support member 18.

The stator fixing portion 21 is a cylindrical member arranged coaxially with the axis of the main shaft 11. The stator of the motor 14 is fixed to the stator fixing portion 21 under a state in which an outer peripheral surface of the stator is fitted along an inner peripheral surface of the stator fixing portion 21.

The first main-shaft mounting portion 23 is a plate-like member, which closes one of openings of the stator fixing portion 21 having the cylindrical shape fitting hole 23*a* into which one end portion of the main shaft 11 is to be fitted is formed in the first main-shaft mounting portion 23. The one end portion of the main shaft 11 is supported in the first main-shaft mounting portion 23 in a state of being fitted into the fitting hole 23*a*.

As illustrated in FIG. 3 and FIG. 4, the brake mounting portions 22 are formed on an outer peripheral portion of the stator fixing portion 21 in accordance with circumferential positions of the brake units 15. In this example, when the hoisting machine 10 is viewed along the axis of the main shaft 11, the two brake mounting portions 22 are arranged at symmetrical positions with respect to the vertical line passing through the axis of the main shaft 11. Each of the brake mounting portions 22 includes a shaft mounting portion 221 and a bolt mounting portion 222. The shaft mounting portion. 221 is formed on the stator fixing portion 21. The bolt mounting portion 222 is arranged below the shaft mounting portion. 221 and is formed on the stator fixing portion 21 and the base portion 30.

A shaft bolt 223, which is a brake mounting shaft, is provided to the shaft mounting portion 221 so as to be parallel to the axis of the main shaft 11. The upper end portion of the brake unit 15 is rotatable mounted to the shaft bolt 223. The brake unit 15 is displaced about the shaft bolt 223 between a mounting position opposed to the outer peripheral surface 12*a* of the brake drum 12 and a maintenance position located on the radially outer side of the brake drum 12 with respect to the mounting position.

The lower end portion of each of the brake units 15 is mounted to the bolt mounting portion 222 with use of a mounting bolt 224, which is a fastener. The brake unit 15 is retained in the mounting position with use of the mounting bolt 224. With removal of the mounting bolt 224 from the bolt mounting portion 222, the brake unit 15 can be displaced between the mounting position and the maintenance position. The hoisting machine 10 is used under a state in which the brake units 15 are retained in the mounting positions. Under a state in which the brake units reach the maintenance positions, maintenance work for the brake units 15 can be performed.

The second support member 18 includes a second main-shaft mounting portion 24 to which another end portion of the main shaft 11 is mounted. The second main-shaft mounting portion 24 has a fitting hole 24*a* into which the another end portion of the main shaft 11 is to be fitted. The another end portion of the main shaft 11 is supported in the second main-shaft mounting portion. 24 in a state of being fitted in the fitting hole 24*a*.

Inside the hoistway 1, a plurality of rail brackets 41 configured to retain the first car guide rail 6 are fixed so as to be spaced away from each other in the vertical direction. Further, inside the hoistway 1, a plurality of rail brackets 42 configured to retain the second car guide rail 7 are fixed so as to be spaced away from each other in the vertical direction. Further, inside the hoistway 1, a plurality of rail brackets 43 configured to retain the first counterweight guide rail 8 are fixed so as to be spaced away from each other in the vertical direction. Further, inside the hoistway 1, a plurality of rail brackets 44 configured to retain the second counterweight guide rail 9 are fixed so as to be spaced away from each other in the vertical direction.

As illustrated in FIG. 2, one or more of the plurality of rail brackets 41 configured to retain the first car guide rail 6 is arranged as an upper rail bracket 41*a* at a position higher than the machine base 20. In this example, one of the plurality of rail brackets 41 configured to retain the first car guide rail 6, which is located at the highest position, is arranged as the upper rail bracket 41*a*. One or more of the plurality of rail brackets 44 configured to retain the second car guide rail 9 is arranged as an upper rail bracket 44*a* at a position higher than the machine base 20. In this example, one of the plurality of rail brackets 44 configured to retain the second car guide rail 9, which is located at the highest position, is arranged as the upper rail bracket 44*a*.

The brake units 15 are each arranged at a position higher than the machine base 20 and lower than the upper rail brackets 41*a* and 44*a*. The hoisting machine 10 is arranged at a position closer to the first car guide rail 6 than to the second counterweight guide rail 9. As viewed from above, the upper rail bracket 41*a* for the first car guide rail 6 overlaps part of a region of one of the two brake units 15, which is closer to the first car guide rail 6, and is arranged outside a region of the brake drum 12. As viewed from above, the upper rail bracket 44*a* for the second counterweight guide rail 9 is located outside a region of the hoisting machine 10. A lower end portion of the upper rail bracket 41*a* and a lower end portion of the upper rail bracket 44*a* are located at positions lower than an upper end portion of the hoisting machine 10.

Figure 6:
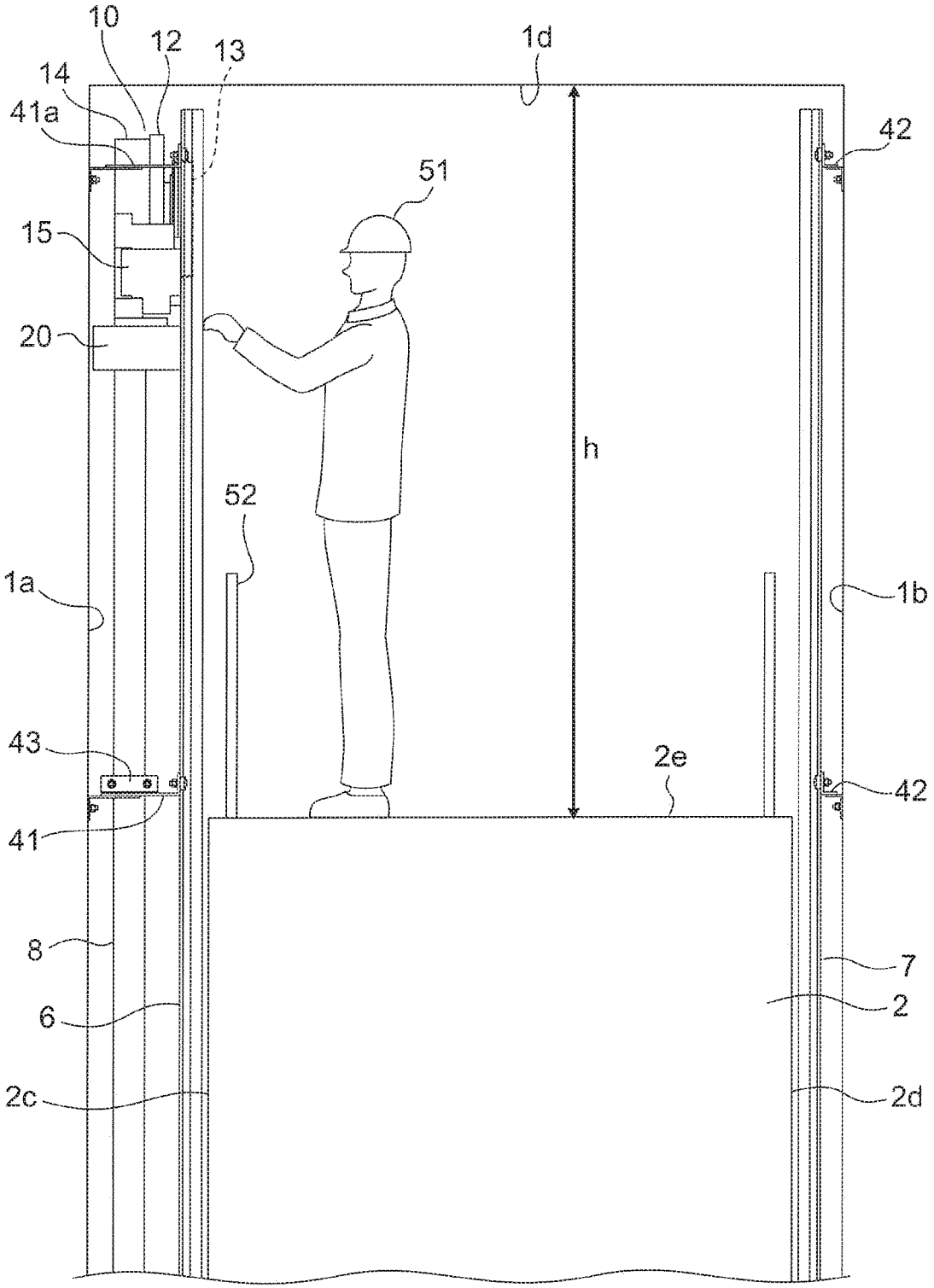
FIG. 6 is a front view for illustrating a state of maintenance work for brake units as viewed from a landing side of FIG. 1.

Next, a procedure of performing the maintenance work for the brake units 15 is described. FIG. 6 is a front view for illustrating a state of the maintenance work for the brake units 15 as viewed from the landing 5 side of FIG. 1. When the maintenance work for the brake units 15 is performed, a maintenance personnel 51 rides from a landing of a top floor onto the upper surface 2*e* of the car 2. After that, a maintenance operation device (not shown) provided on a top of the car 2 is operated to raise the car 2 at low speed and then stop the car 2 at such a position below the hoisting machine 10 as to allow the maintenance work for the hoisting machine 10. At this time, the car 2 is stopped at a maintenance stop position at which a distance h between a ceiling 1*d* of the hoistway 1 and the upper surface 2*e* of the car 2 becomes equal to or larger than a set value of 2,000 mm.

After that, the maintenance personnel 51 performs the maintenance work for the brake units 15 from below the hoisting machine 10. At this time, the maintenance personnel 51 stands on a range of the upper surface 2*e* of the car 2, which is surrounded by a car top handrail 52, to perform the maintenance work. At this time, the brake units 15 are located on an outer side of the cord-like members 31 extending downward from the driving sheave 13, and the brake units 15 are oriented obliquely downward. As a result, the maintenance work for the brake units 15 is facilitated.

When the maintenance work for the brake units 15 is performed, the maintenance personnel 51 operates the mounting bolts 224, which fix the brake units 15, from below the hoisting machine 10 to remove the mounting bolts 224 from the bolt mounting portions 222. As a result, each of the brake units 15 can be displaced from the mounting position to the maintenance position. After that, the maintenance personnel 51 performs the maintenance work for the brake units 15 such as replacement of the lining 154 under a state in which the brake units 15 have been displaced to the maintenance positions. After the maintenance work for the brake units 15 is terminated, the maintenance personnel 51 displaces the brake units 15 from the maintenance positions to the mounting positions and fixes the brake units 15 to the mounting positions with use of the mounting bolts 224.

After that, the maintenance personnel 51 operates the maintenance operation device to lower the car 2 at low speed, and thereafter moves down from the upper surface 2*e* of the car 2 onto the landing of the top floor. As described above, the maintenance work for the brake units 15 is performed.

In the elevator device described above, the brake units 15 configured to press the movable members 151 against the outer peripheral surface 12*a* of the brake drum 12 in an obliquely upward direction are each arranged at the position higher than the machine base 20 and lower than the upper rail bracket 41*a* for the first car guide rail 6. Thus, the brake units 15 can be arranged on an obliquely lower side as viewed from the axis of the main shaft 11, and hence a projecting amount of each of the brake units 15 toward a horizontally outer side and a vertically outer side of the brake drum 12 can be set smaller than a thickness dimension of each of the brake units 15. In this manner, downsizing of the hoisting machine 10 can be achieved. Further, in comparison to a case in which the movable members 151 are pressed downward or in the horizontal direction against the outer peripheral surface 12*a* of the brake drum 12, the brake units 15 can be arranged at the lower positions with respect, to the main shaft 11. Thus, the position of the machine room 20 can be set closer to the ceiling id of the hoistway 1 while ensuring the distance h from the upper surface 2*e* of the car 2 to the ceiling to of the hoistway 1 when the car 2 is stopped at the maintenance stop position, which is equal to or larger than the set value. Further, the upper rail bracket 41*a* for the first car guide rail 6 is arranged above the brake units 15. As a result, the upper end portion of the hoisting machine 10 can be arranged at the position higher than the upper rail bracket 41*a* for the first car guide rail 6, and hence the position of the machine base 20 can be set more closer to the ceiling 1*d* of the hoistway 1. In this manner, the range of vertical movement of the counterweight 3 can be increased to achieve the space saving in the hoistway 1. Further, the brake units 15 can be arranged on the obliquely lower side as viewed from the axis of the main shaft 11. Thus, the maintenance personnel 51 on the upper surface 2*e* of the car 2 can easily access the hoisting machine 10 from below. Thus, a burden of the maintenance work can be alleviated.

Further, when the hoisting machine 10 is viewed from above, part of the brake units 15 overlaps the region of the upper rail bracket 41*a* for the first car guide rail 6. Thus, the position of the hoisting machine 10 can be set closer to the first car guide rail 6 without interference of the brake units 15 with the upper rail bracket 41*a*. In this manner, a degree of freedom in layout of the hoisting machine 10 can be improved.

Further, when the brake units 15 are viewed along the axis of the main shall 11, the upper end portion of each of the brake units 15 is located below the horizontal line A passing through the axis of the main shaft 11. Thus, with the setting of the upper end portions of the brake units 15 closer to the upper rail bracket 41*a*, the upper end portion of the hoisting machine 10 can be arranged at a higher position. Thus, the position of the machine base 20 can be set closer to the ceiling Id of the hoistway 1. As a result, the range of vertical movement of the counterweight 3 can be further increased, and hence further space saving in the hoistway can be achieved.

In the example described above, when the brake units 15 are viewed along the axis of the main shaft 11, the upper end portions of the brake units 15 are located below the horizontal line A passing through the axis of the main shaft 11. However, when the brake units 15 press the movable members 151 against the outer peripheral surface 12*a* of the brake drum 12 in the obliquely upward direction, the upper end portions of the brake units 15 may be located above the horizontal line A passing through the axis of the main shaft 11. Accordingly, for example, upper end portions of the linings 154 may be located below the horizontal line passing through the axis of the main shaft 11, and the upper end portions of the brake units 15 may be located above the horizontal line A passing through the axis of the main shaft 11.

In the example described above, the upper rail bracket 44*a* for the second counterweight guide rail 9 is located outside the region of the hoisting machine 10 as viewed from above. However, the upper rail bracket 44*a* for the second counterweight guide rail 9 may be arranged so as to overlap part of a region of another one of the brake units 15 as viewed from above. In this case, the upper rail bracket 44*a* for the second counterweight guide rail 9 is located at a position outside the region of the brake drum 12 as viewed from above. In this manner, a position of the second counterweight guide rail 9 can be set closer to the hoisting machine 10. Thus, further space saving in the hoistway 1 can be achieved.

REFERENCE SIGNS LIST

1 hoistway, 2 car, 3 counterweight, 6 first car guide rail, 7 second car guide rail, 8 first counterweight guide rail, 9 second counterweight guide rail, 10 hoisting machine, 11 main shaft, 12 brake drum, 12*a* outer peripheral surface, 15 brake unit, 20 machine base, 41*a* upper rail bracket, 151 movable member

The invention claimed is:

1. An elevator device, comprising:

a car vertically movable in a hoistway;

a car guide rail, which is provided in the hoistway, and is configured to guide the car;

a counterweight vertically movable in the hoistway;

a counterweight guide rail, which is provided in the hoistway, and is configured to guide the counterweight;

a hoisting machine, which is provided in an upper part of the hoistway, and is configured to generate a driving force for moving the car and the counterweight; and a machine base configured to support the hoisting machine, wherein the hoisting machine includes a main shaft, a brake drum rotatable about an axis of the main shaft, and a brake unit arranged at a position on a radially outer side of the brake drum, wherein the brake unit includes a movable structure and presses the movable structure in an obliquely upward direction against an outer peripheral surface of the brake drum to apply a braking force to the brake drum, and wherein the car guide rail is retained by an upper rail bracket at a position higher than a position of the machine base, and wherein the brake unit is arranged at a position higher than the machine base and lower than the upper rail bracket, wherein the upper rail bracket overlaps a region of the movable structure of the brake unit and an entirety of the upper rail bracket is outside a region of the brake drum as viewed from above.

2. The elevator device according to claim 1, wherein, when the brake unit is viewed along the axis of the main shaft, an upper end portion of the brake unit is located lower than a horizontal line passing through the axis of the main shaft.

3. The elevator device according to claim 1, wherein a lower end of the upper rail bracket is positioned lower than an upper end portion of the hoisting machine.

4. The elevator device according to claim 1, further comprising:

a driving sheave;

a counterweight suspension sheave; and a cord which wraps around the driving sheave and the suspension sheave.

5. The elevator device according to claim 4, wherein:

an entirety of the cord from where the cord first contacts to the driving sheave to where the cord first contacts the counterweight suspension sheave is substantially vertical.

6. The elevator device according to claim 4, wherein:

the elevator device is a machine-room-less type elevator.

* * * * *